US005720848A

United States Patent [19]

Oyama et al.

[11] Patent Number: 5,720,848

[45] Date of Patent: Feb. 24, 1998

[54] CLOTH FUSING PRESS

[75] Inventors: Toshihiro Oyama; Shinji Toyoda, both of Higashiosaka, Japan

[73] Assignee: Naomoto Industry Co., Ltd., Osaka, Japan

[21] Appl. No.: 557,911

[22] Filed: Nov. 14, 1995

[30] Foreign Application Priority Data

Feb. 2, 1995 [JP] Japan ..... 7-039335

[51] Int. Cl.[6] ..... B32B 31/20

[52] U.S. Cl. ..... 156/555; 156/582; 156/583.1; 271/164

[58] Field of Search ..... 271/9.12, 162, 271/164; 156/538, 539, 555, 580, 583.1, 582

[56] References Cited

U.S. PATENT DOCUMENTS 1,640,400 8/1927 Fellows ..... 271/164

3,962,021 6/1976 Weisfeld ..... 156/499

4,208,666 6/1980 Paranjpe ..... 346/75

4,998,714 3/1991 Sparer et al. ..... 271/117

5,261,992 11/1993 Moll ..... 156/308.2

5,273,272 12/1993 Nakamura et al. ..... 271/167

*Primary Examiner*—James Sells

*Attorney, Agent, or Firm*—Armstrong, Westerman, Hattori, McLeland & Naughton

[57] ABSTRACT

A cloth fusing press for joining a piece of adhesive interlining fabric to a rear face of a piece of cloth provided with a conveyor conveying a piece of work which consists of piled cloth and adhesive interlining fabric, a heater heating the work being conveyed by the conveyor, and a pressure device pressing the heated work. A table for feeding work which feeds the work to the conveyor when the table is adjacent to the conveyor and freely reciprocates for a predetermined stroke in the direction toward or away from the conveyor is arranged near the inlet of the conveyor.

6 Claims, 6 Drawing Sheets

CLOTH FUSING PRESS

FIELD OF THE INVENTION

This invention relates to a cloth fusing press.

BACKGROUND OF THE INVENTION

In order to prevent a sack coat from getting out of shape, adhesive interlining fabric is applied to portions which easily get out of shape. This adhesive interlining fabric is attached to the back face of the cloth for the sack coat by using a cloth fusing press.

A cloth fusing press of this kind conveys a piece of work of piled cloth and adhesive interlining fabric by a conveyor belt, heats the work while it is conveyed, applies pressure on the work under this heating situation, and joins the cloth and adhesive interlining fabric.

In feeding the work, the work is placed on a pan of the conveyor belt protruding forwardly.

The foregoing conventional cloth fusing press requires a skilled worker in order to place the work on a pan of the running conveyor belt so that the adhesive interlining fabric does not slip on the cloth.

The conveyor belt is long, and therefore the belt, heated by the heating means, tends to grow cold and the cost becomes higher.

SUMMARY OF THE INVENTION

It is therefore an object of the present invention to provide a cloth fusing press which accurately feeds cloth and adhesive interlining fabric to the conveyor means so that the adhesive interlining fabric does not slip on the cloth and fuses the cloth and adhesive interlining fabric.

BRIEF DESCRIPTION OF THE DRAWING FIGURES

The present invention will be described with reference to the accompanying drawings, in which.

DETAILED DESCRIPTION OF THE INVENTION

Preferred embodiments of the present invention will now be described with reference to the accompany drawing figures.

Figure 1:
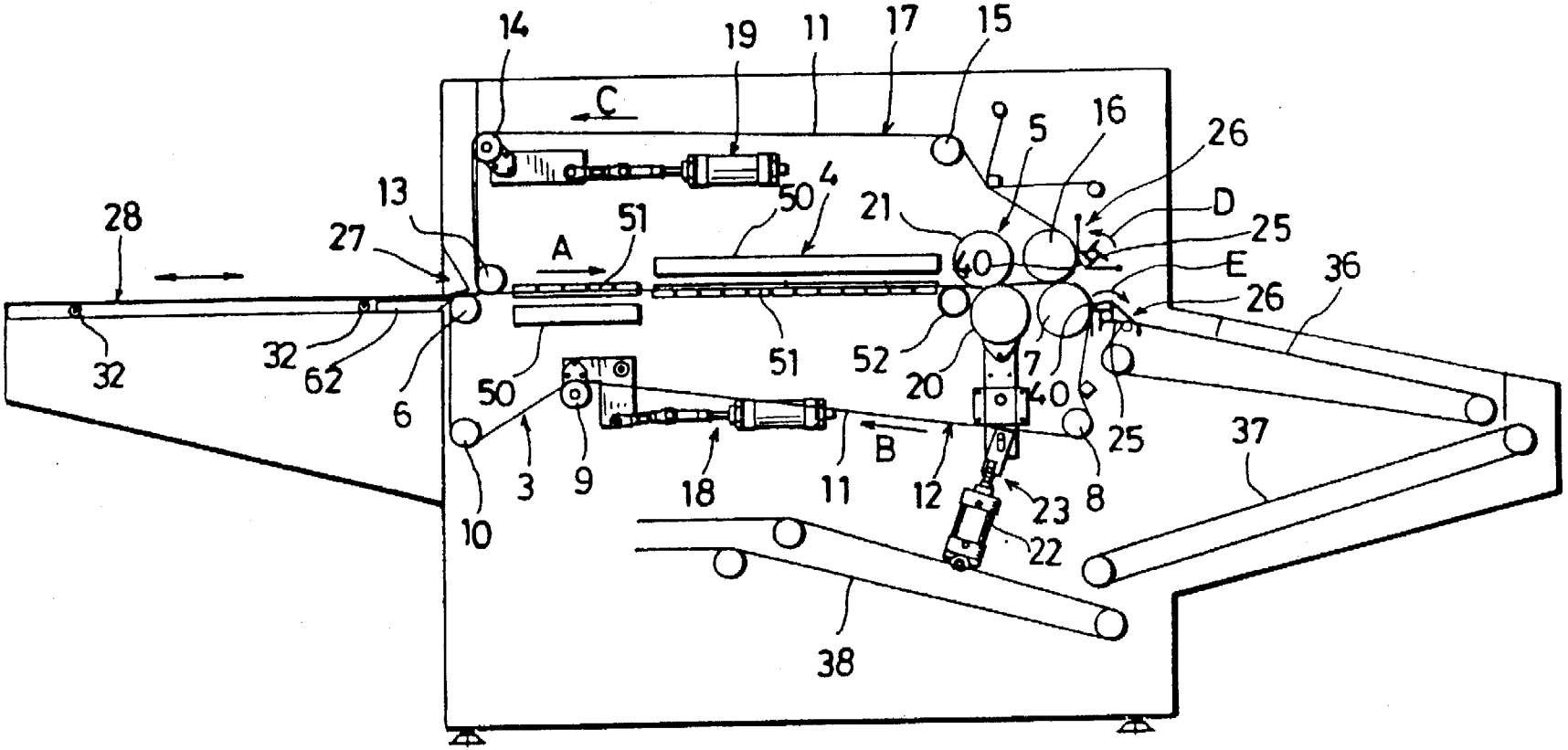
FIG. 1 is a schematic view showing a preferred embodiment of the present invention.

FIG. 1 shows a cloth fusing press according to the present invention. The cloth fusing press is provided with a conveyance means 3 conveying a piece of work or workpiece W (see FIG. 6) formed by piling a piece of cloth 1 and a piece of adhesive interlining fabric 2, a heating means 4 for heating the work or workpiece W while it is conveyed by the conveyance means 3, and a pressure means 5 for applying pressure to the work or workpiece W once heated.

The conveyance means 3 is provided with a first member 12 which includes five rollers 6, 7, 8, 9, and 10 and a conveyor belt 11 hung on the rollers 6, 7, 8, 9, and 10 and a second member 17 which includes four roller 13, 14, 15, and 16 and a conveyor belt 11 on the rollers 13, 14, 15, and 16. The roller 9 and roller 14 are oscillated or reciprocated in order to appropriately tension the belts 11 and correct meandering.

In this case, it is preferable to add a static electricity inhibitor to the material for the conveyor belts 11. The static electricity inhibitor is, for example, inductive metal, which prevents static electricity from occurring and causing the work or workpiece W to stick to the belts 11.

The heating means 4 includes, for example, an electromagnetic induction heater 50 and a hot plate 51 heated by the electromagnetic induction heater 50. The electromagnetic induction heater 50 and the hot plate 51 are provided along the traveling path of the work W and the hot plate 51 heats the work or workpiece W conveyed near the hot plate 51 by the belts 11. Adhesive is applied to the adhesive interlining fabric 2 and is melted by the heat. It is also possible to use a hot plate heated by a steam heater or an electric heater as the heating means 4.

The pressure means 5 is placed nearer to the outlet side than the heating means 4 and is provided with pressure rollers 20 and 21 for pressing. In this case, a roller 20 moves toward or away from the other roller 21 due to a driving means 23 having a cylinder 22. This pair of rollers 20, 21 thereby presses running work W with an appropriate pressure.

A spherical roller 52 is arranged in front of the pressure rollers 20 and 21 and freely rolls. The spherical roller 52 is arranged in front of the pressure rollers 20 and 21 and freely rolls. The spherical roller 52 is used to increase the tension of both the belts 11 and the work or workpiece W and to stagger the times for the central portion and both end portions in the width direction of a marginal end of the work W to be inserted between the pressure rollers 20 and 21. This prevents the work or workpiece W from loosening or clogging when the work W is inserted.

Rotary exfoliating devices 26 are placed near the outlet after heating and pressing, and are provided with fans 25 for separating the work or workpiece W from the conveyor belts 11. The fans 25 are attached to shafts which are rotated by motors or other driving means and are not shown in the attached drawings. It is desirable to use rubber or plastic as the material for the fans 25.

The conveyor belt 11 of a first member 12 of the conveyance means 3 travels in the direction of the arrow B and the conveyor belt 11 of a second member 17 travels in the direction of the arrow C. Therefore, the upper and lower conveyor belts 11 convey the work or workpiece W toward the direction of the arrow A, the shaft of an upper rotary exfoliating device 26 rotates in the direction as shown by the arrow D in FIG. 1, and the shaft of the other lower rotary exfoliating device 26 rotates in the direction by the arrow E in FIG. 1.

If the melted adhesive of the adhesive interlining fabric 2 of the work or workpiece W oozes or leaks and the work or workpiece W sticks to one of the belts 11, for example, the upper conveyor belt 11 and would travel with this conveyor belt 11, the fan 25 of the upper rotary exfoliating device 26 strips off the work or workpiece W and the work or workpiece W is separated from the upper conveyor belt 11.

If the work W sticks to the lower conveyor belt 11 and would travel with this conveyor belt 11, the fan 25 of the lower rotary exfoliating device 26 strips off the work or workpiece W and the work or workpiece W is separated from the lower conveyor belt 11.

Each rotary exfoliating device 26 is provided with a guide portion 40 which prevents the work W from winding around the fan 25.

Because of the guide portion 40, the work or workpiece W which was stripped from the conveyor belt 11 by the fan 25 does not approach the fan 25 beyond this guide portion 40. Therefore, the work or workpiece W does not wind around the fan 25.

The rotary exfoliating devices 26 are followed by conveyors 36, 37, and 38, successively.

Two tables 28 for feeding the work or workpiece W are placed at the inlet 27 side of the conveyance mean 3. Each table 28, as shown in FIG. 2, FIG. 3A, FIG. 3B, and FIG. 3C, is provided with a rectangular main body 29, left and right walls 30 hanging from the main body 29, and a front wall 31 hanging from the main body 29. Freely rolling rollers 32 are provided at the front and rear of the inner faces of the left and right walls 30, and corresponding to the rollers 32, freely rolling four rollers 33 are attached to the inner face (i.e., the rear face) of the main body 29. In this case, the rollers 32 roll on horizontal axes, and the rollers 33 roll on vertical axes.

The tables 28 are placed on a table base 41 and freely slide back and forth. Depressed grooves 42 are formed on the base 41 and fit the tables 28 so that the tables 28 freely slide and guide rails 43, having an U-shaped configuration in cross-section, are arranged along the inner faces of the depressed grooves 42.

Figure 2:
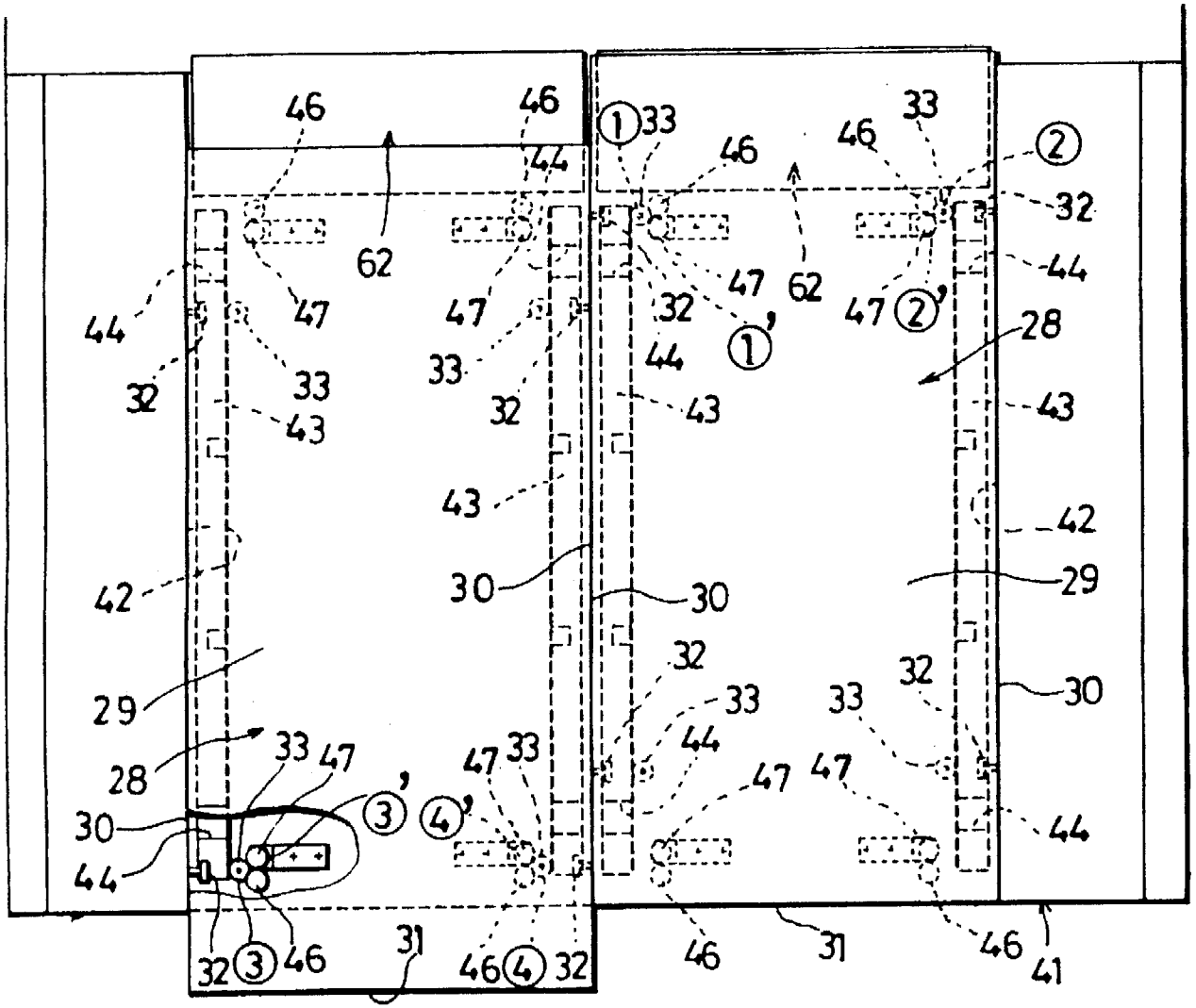
FIG. 2 is a top plan view of a table for feeding work.
Figure 4:
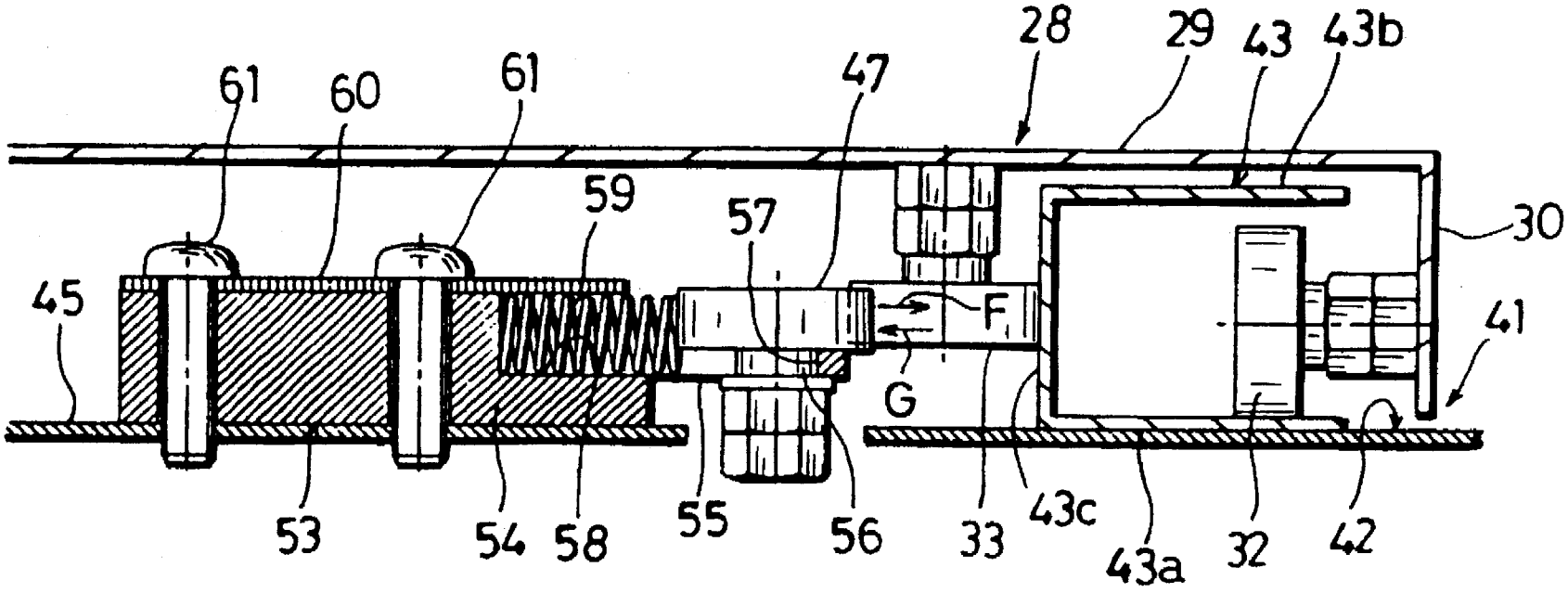
FIG. 4 is a partly diagrammatic grossly enlarged sectional view of the table for feeding work.

As shown in FIG. 4, a roller 32 is kept inside the guide rail 43, and the roller 32 rolls and moves inside the bottom side 43*a* of the guide rail 43. As shown in FIG. 2, the upper side 43*b* of the guide rail 43 is provided with notched portions 44. The roller 32 is inserted in the guide rail 43 through the notched portions 44.

Groups of rollers, each including first and second rollers 46, 47, are respectively attached to the front, rear, left, and right of the bottom face 45 of the depressed groove 42. Roller 46 has a fixed vertical axis, and roller 47 has a vertical axis freely reciprocating as shown with F and G in FIG. 5 in a plan view.

As shown in FIG. 4, a block body 53 is attached to the bottom face 45 of the depressed groove 42. This block body 53 consists of a main body portion 54 and a protrusion 55 protruding from the central portion of the front face of the main body portion 54. The protrusion 55 is provided with a long hole 57 where an axis 56 of the roller 47 fits and freely slides in the direction as shown by the arrows F and G. A groove 58, connected with the long hole 57, is formed on the main body portion 54 and an elastic member 59, including a coiled spring which bounces the roller 47 in the direction of the arrow F (i.e., the inward direction in the left and right directions), fits into the groove 58.

An upper plate 60 is attached to the upper face of the block body 53. The block body 53 and the upper plate 60 are provided with through-holes, where bolt members 61 are inserted and attached to the bottom wall of the depressed grove 42. In a free situation, as shown by solid lines in FIG. 5, the dimension from the axis of the roller 47 to the side 43*c* of the guide rail 43 and the dimension from the axis of the fixed roller 46 to the side 43*c* of the guide rail 43 are substantially equal. The rollers 47 and 46 are arranged to be adjacent to each other and to be at approximately the same height.

If the rollers 32 are inserted into the guide rail 43 through the notched portions 44 of the guide rail 43, the rollers 32 travel inside the guide rail 43, and the roller 33 rotates and moves along the side 43*c* of the guide rail 43. The table 28 thereby slides back and forth along the guide rails 43. In this case, the roller 33 is kept at substantially the same height as the rollers 46, 47.

Figure 5:
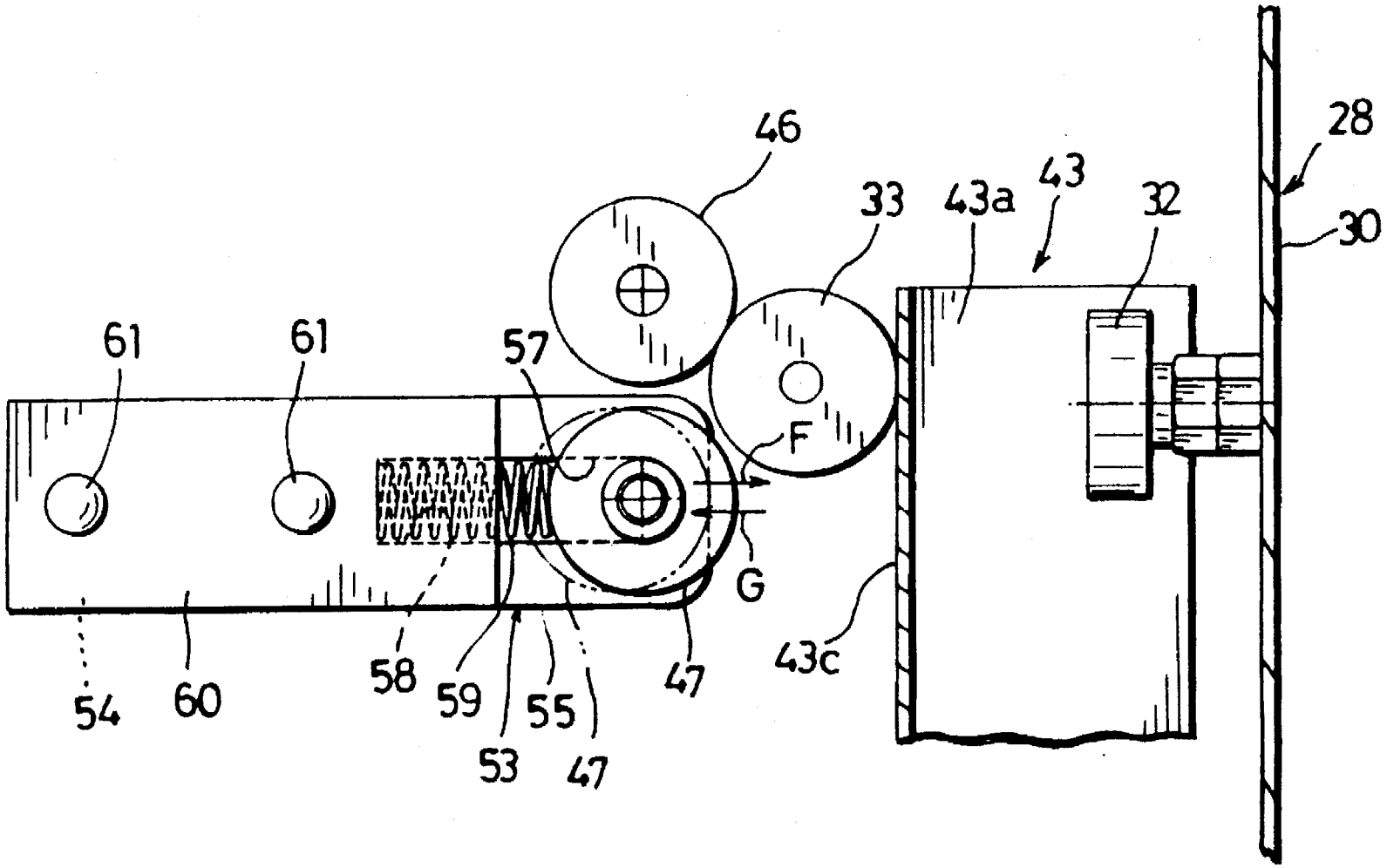
FIG. 5 is a partly diagrammatic plan view of the table for feeding work.

When the table 28 slides backwards, as does the right table 28 in FIG. 2, the backward rollers 33 of ① and ② are respectively fitted between the rollers 46, 47 and further sliding of the table 28 is restricted. When the table 28 is gradually slid backwards, the roller 33 of ① and ② respectively push the roller 47 of ①' and ②' in the direction of the arrow G shown in FIG. 5, which is against the elasticity of the elastic member 59, and the rollers 33 thereby move beyond the rollers 47. At that moment, the roller 47 are released from the pressure of the rollers 33 in the direction of the arrow G and return to the former situation, and as shown in FIG. 5, the rollers 33 are fitted between the roller 46 and 47.

From this situation, if the right table 28 is drawn toward this side, the rollers 33 of ① and ② respectively push the rollers 47 of ①' and ②' toward the direction of the arrow G and are released form this firing situation, and the table 28 thereby freely slides toward this side.

When the table 28, which slides forward is the left table 28, the forward rollers 33 of ③ and ④ are respectively fitted between the rollers 46, 47 so that further sliding of the table 28 is restricted. When the table 28 is gradually slid toward this side, the rollers 33 of ③ and ④ respectively push the rollers 47 of ③' and ④' against the elasticity of the elastic members 59. The rollers 33 of ③ and ④ thereby move beyond the rollers 47 of ③' and ④' and fitted between the rollers 46, 47. Conversely, if the left table 28 is pushed backwardly from this situation, the rollers 33 of ③ and ④ respectively push the rollers 47 of ③' and ④' in the direction of the arrow G and are released from this fitting situation, and the table 28 thereby freely slides backwardly.

A fixed receiving plate 62 is attached to the back side of the depressed groove 42 of the table base 41, i.e. the inlet 27 side of the conveyance means 3. When the table 28 is slid backwardly, as shown in the right side of FIG. 2, the rear end portion of the table 28 covers substantially all the face of the fixed receiving plate 62. When the table 28 is slid forwardly, as shown in left side of FIG. 2, the rear end portion of the table 28 covers a part of the fixed receiving plate 62.

Therefore, when each table 28 for feeding the work or workpiece W reciprocates for a predetermined stroke toward and away from the conveyance means 3 and slides backwardly as does the right table 28 in FIG. 2, the work or workpiece W placed on the table 28 is fed to the conveyance means 3. A stroke is defined as the amount of difference from the situation of the left table 28, shown in FIG. 2, which is drawn toward this side, to the situation of the right table 28, shown in FIG. 2, which is pushed backwardly.

As shown in FIG. 3, a connection bar 63 is attached to the front wall 31 of one of the tables 28, and the neighboring tables 28 can be connected with this connection bar 63.

Figures 3A, 3B, 3C:
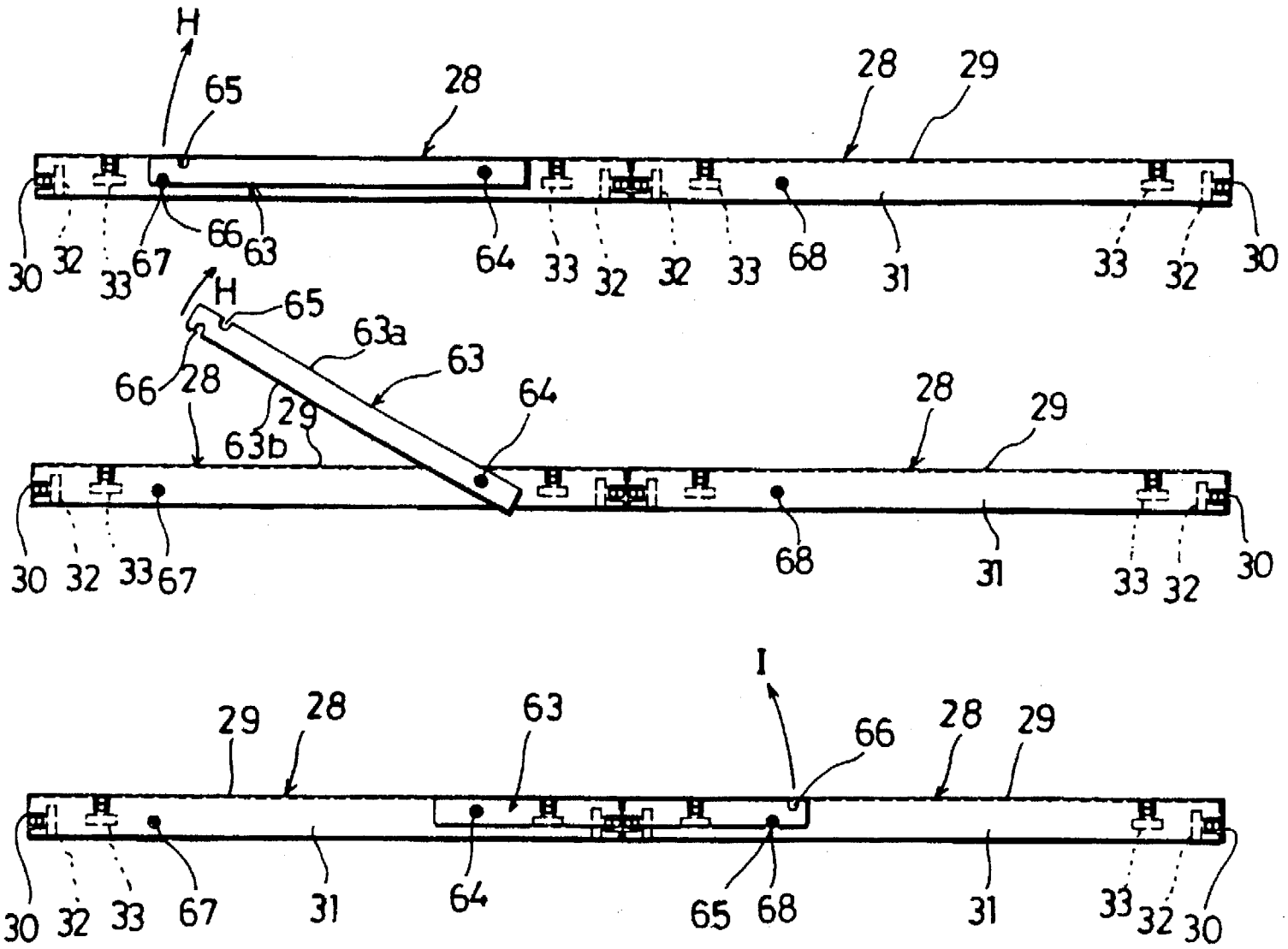
FIG. 3A is an elevational view of the table for feeding work.
FIG. 3B is an elevational view of the table for feeding work.
FIG. 3C is an elevational view of the table for feeding work.

The connection bar 63 is pivoted through a pivot pin 64 an end portion of which is provided at the front wall 31, and the connection bar 63 oscillates in the direction of the arrows H and I. The end portion side of the side margin 63*a* of the connection bar 63 and the end portion side of the other side margin 63b are respectively provided with notched portions 65, 66, and as shown in FIG. 3A. In a situation wherein the connection bar 63 is parallel with the front wall 31 of one of the table 28, the notched portion 66 keeps being fastened by a fastening pin 67 arranged at the front wall 31 of the table 28. If the connection bar 63 is oscillated in the direction of the arrow H from this situation, the connection bar 63 oscillates on the pivot pin 64 as shown in FIG. 3B. When the connection bar 63 is laid across the neighboring tables 28, the notched portioned 65 is kept fastened by a fastening pin 68 arranged at the front wall 31 of the other table 28.

When the connection bar 63 is laid across the neighboring tables 28, as shown in FIG. 3C, the two tables 28 unitedly slide forwardly and backwardly. When the connection bar 63 corresponds to only one of the tables 28, as shown in FIG. 3A, each table 28 slides independently.

Next, using a cloth fusing press composed as described in the foregoing, the operation of fusing cloth 1 and adhesive interlining fabric 2 is as described below.

Figure 6:
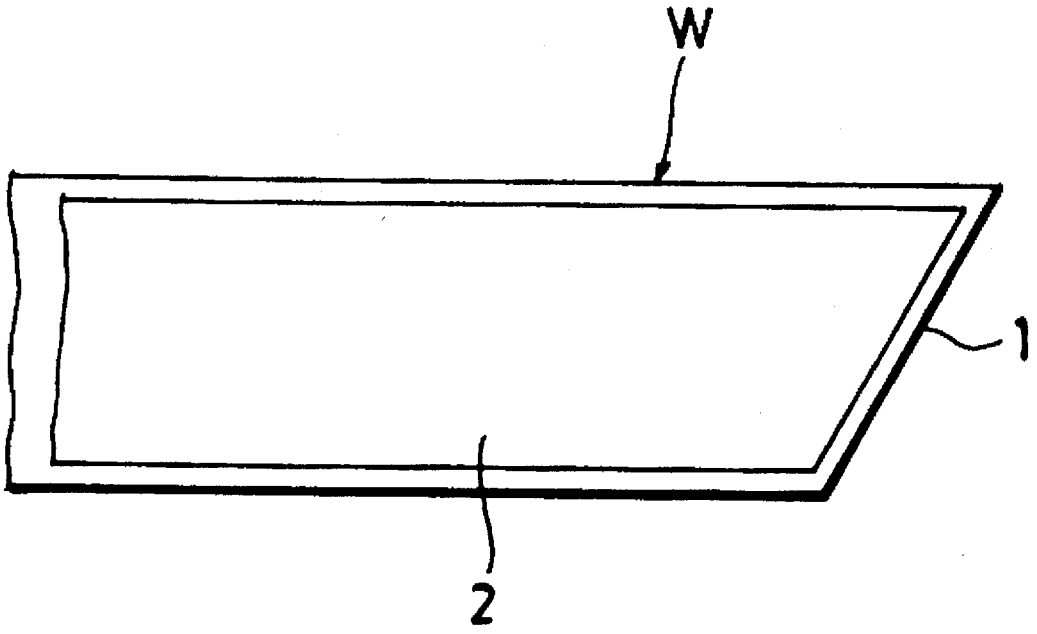
FIG. 6 is a schematic perspective view of work.

First, as shown in FIG. 6, a piece of cloth 1 and a piece of adhesive interlining fabric 2 are piled one over the other to form a piece of work or workpiece W.

In a situation in which the table 28 for feeding the work or workpiece W on the table base 41 is drawn toward this side, the work or workpiece W is placed on the table 28. The table 28 is pushed toward the inlet 27 side of the conveyance means 3 so that the table 28 approaches the conveyance means 3.

The work or workpiece W, placed on the table 28, is thereby fed to the inlet 27, and the conveyance means 3 conveys the work or workpiece W to the heating means 4 as in the direction of the arrow A as shown in FIG. 1. When the work or workpiece W passes through the heating means 4, the work or workpiece W is heated, and this melts the adhesive of the adhesive interlining fabric 2. The conveyance means 3 further conveys the work or workpiece W, in this situation, to the pressure means 5, where the work or workpiece W is pressed by the rollers 20, 21 to fuse the cloth 1 and the adhesive interlining fabric 2. Then the cloth 1, fused to the adhesive interlining fabric 2, is sent out between the rollers 7 and 16 and comes outside through the conveyors 36, 37 and 38.

When the work or workpiece W is fed to the conveyance means 3, it is possible to feed the work or workpiece W, placed on the table 28, to the conveyance means 3 without touching the work or workpiece W, and the adhesive interlining fabric 2 does not slip on the cloth 1.

In the foregoing embodiment, a spherical roller 52 is arranged just before the pressure rollers 20, 21. Therefore, tension of the conveyor belts 11 and the work or workpiece W can be increased. The central portion and both end portions in the width direction of a marginal end of the work or workpiece W are inserted between the pressure rollers 20 and 21 at staggered times. This prevents the work or workpiece W from loosening or clogging when the work or workpiece W is inserted and creases, waves or lateral-stripped patterns do not occur on the work or workpiece W.

In case the work or workpiece W sticks to one of the conveyor belts 11, for example, by means of adhesive leaking from the adhesive interlining fabric 2, the fan 25 of the rotary exfoliating device 26 prevents the work or workpiece W from sticking to the conveyor belt 11, and thereby the work or workpiece W is surely conveyed by the conveyors 36, 37 and 38.

Moreover, the work or workpiece W, stripped from the conveyor belt 11 by the fan 25, does not approach the fan 25 side beyond this guide portion 40. Therefore, the work or workpiece W does not wind around tie fan 25, and the fused cloth 1 and interlining fabric 2 are more easily fed to the conveyor 36.

Two tables 28 for feeding the work or workpiece W are used in the foregoing embodiment, and it is possible to feed two kinds of works or workpieces W to this apparatus for fusing. It is therefore preferable to arrange the heating means 4 so that the hot plate is divided into two sections to the left and right in the width direction of the work or workpiece W. It is also preferable that a temperature regulator controls temperature of each section independently. Needless to say, it is possible to use a hot plate not divided into sections. The temperature regulator can be composed of a power supply and a regulator regulating and supplying electric current from the power supply to an electromagnetic induction coil (of the electromagnetic induction heater).

The hot plate may be provided with a sensor which detects the temperature of the hot plate. The temperature detected by the sensor is inputted into the regulator, and the regulator controls electric current fed to the coil. This keeps temperature of each divided section to be separately uniform, and it is therefore possible to fuse different kinds of works or workpieces W synchronously using this cloth fusing press.

In case the width of the work or workpiece W is relatively large, it is possible to place the work or workpiece W of a large width on the two tables 28 by connecting the neighboring tables 28 with the connection bar 63 as shown in FIG. 3C and thereby feed the work or workpiece W of a large width to the inlet 27 by sliding the two tables 28 synchronously.

According to the present invention, after placing or setting the work or workpiece W on the table 28 for feeding the work or workpiece W, it is possible to feed the work or workpiece W to the conveyance means 3 without touching the work or workpiece W and thus, the adhesive interlining fabric 2 does not slip on the cloth 1. Therefore, quality goods are produced. In other words, the worker does not need to feed the work or workpiece W by adjusting its position. Therefore, the operation does not require skill. This apparatus is especially suitable for fusing thin cloth 1 and thin adhesive interlining fabric 2.

When the apparatus is provided with at least two tables 28 for feeding the work or workpiece W on the left and right sides of the width direction of the work or workpiece W, it is possible to surely feed plural kinds of works or workpieces W to the conveyance means 3 so that the adhesive interlining fabrics 2 does not slip on the cloths 1. The apparatus thus excels in operating efficiency.

When the apparatus is arranged so that neighboring tables 28 for feeding the work or workpiece W can be connected with a connection bar 63, the apparatus is capable of fusing works or workpieces W of various sizes.

While preferred embodiments of the present invention have been described in this specification, it is to be understood that the invention is illustrative and not restrictive, because various changes are possible within the spirit and scope of the invention.

That is to say, the number of tables 28 for feeding the work or workpiece W can be three or more, or on the contrary, one. The table 28 for feeding the work or workpiece W is slid back and forth by hand in the embodiments. However, the table 28 can be slid utilizing the driving force of a cylinder or a motor.

It is possible to arrange the conveyors 36 and 37 so that they are inserted in a humidifying chamber. In other words, the work or workpiece W heated by the heating means 4 is deprived of water and shrinks. The work or workpiece W may be supplied with water and restored to its original state by contacting it with the vapor of the humidifying chamber. The cloth 1 fused with the adhesive interlining fabric 2 is thereby restored to its original size. This prevents flagging when the cloth 1 is sewn together with another piece of cloth which is not fused with adhesive interlining fabric.

We claim:

1. A cloth fusing press comprising:

a conveyance means for conveying a workpiece, wherein said workpiece is formed by piling a piece of cloth and a piece of adhesive interlining fabric;

a heating means for heating said workpiece while said workpiece is being conveyed by said conveyance means;

a pressure means for applying pressure to said workpiece, after said workpiece has been heated;

a table means for feeding said workpiece placed on said table means to said conveyance means so that said piece of adhesive interlining fabric does not slip on said piece of cloth and said piece of adhesive interlining material is fused to said piece of cloth in an accurate position, said table means being adjacent to said conveyance means, arranged near an inlet of said conveyance means, and reciprocated in both a direction toward and a direction away from said conveyance means for a predetermined stroke;

wherein groups of rollers, each said group of rollers consisting of a pair of first and second rollers, are arranged at a front end, a rear end, a left side, and a right side of a base of said table means, said pair of first and second rollers arranged at said front end and said rear end of said table means being freely reciprocable in left and right directions with respect to said direction of said workpiece;

elastic means for pushing said pair of first and second rollers arranged at said front end and said rear end of said table means to be freely reciprocable inwardly in said left and right directions with respect to said width direction of said workpiece are attached to said pair of first and second rollers arranged at said front end and said rear end of said table means to be freely reciprocable rollers; and rollers, arranged at said front end, said rear end, said left, and said right of said table means for feeding said workpiece, push said pair of first and second rollers arranged at said front end and said rear end of said table means to be freely reciprocable rollers against an elasticity of said elastic means because of sliding of said table means for feeding said workpiece in a back and forth direction and fit between said first and second rollers of said groups of rollers in order to control sliding of said table means for feeding said workpiece in said back and forth direction.

2. A cloth fusing press comprising:

conveyance means for conveying a workpiece, wherein said workpiece is formed by piling a piece of cloth and a piece of adhesive interlining fabric;

heating means for heating said workpiece while said workpiece is being conveyed by said conveyance means;

pressure means for applying pressure to said workpiece, after said workpiece has been heated;

at least two table means for feeding said workpiece placed on said at least two table means to said conveyance means so that said piece of adhesive interlining fabric does not slip on said piece of cloth and said piece of adhesive interlining fabric is fused to said piece of cloth in an accurate position, said at least two table means being adjacent to said conveyance means, arranged near an inlet of said conveyance means when said at least two table means are adjacent to said conveyance means, arranged near said inlet of said conveyance means on a left and a right of a width direction of said workpiece and reciprocated in both a direction toward and a direction away from said conveyance means for a predetermined stroke;

wherein groups of rollers, each said group of rollers consisting of a pair of first and second rollers, are arranged at a front end, a rear end, a left side, and a right side of a base of said table means, said pair of first and second rollers arranged at said front end and said rear end of said table means being freely reciprocable in left and right directions with respect to said direction of said workpiece;

elastic means for pushing said pair of first and second rollers arranged at said front end and said rear end of said table means to be freely reciprocable inwardly in said left and right directions with respect to said width direction of said workpiece are attached to said pair of first and second rollers arranged at said front end and said rear end of said table means to be freely reciprocable rollers; and rollers, arranged at said front end, said rear end, said left, and said right of said table means for feeding said workpiece, push said pair of first and second rollers arranged at said front end and said rear end of said table means to be freely reciprocable rollers against an elasticity of said elastic means because of sliding of said table means for feeding said workpiece in a back and forth direction and fit between said first and second rollers of said groups of rollers in order to control sliding of said table means for feeding said workpiece in said back and forth direction.

3. A cloth fusing press provided with a conveyance means conveying work formed by piling a piece of cloth and a piece of adhesive interlining fabric, a heating means heating the work while it is conveyed by said conveyance means, and a pressure means applying pressure to the heated work, wherein the improvement comprises:

at least two tables for feeding work, which feed work placed on the tables to the conveyance means when the tables are adjacent to the conveyance means, arranged near the inlet of the conveyance means on left and right in the width direction of the work and reciprocated in the direction toward or away from the conveyance means for a predetermined stroke, and a connection bar for switching the neighboring tables for feeding work between a situation of being connected and reciprocated unitedly and a situation of being unconnected and reciprocated independently.

4. The cloth fusing press as set forth in claim 3, wherein groups of rollers, each said group of rollers consisting of a pair of first and second rollers, are arranged at a from end, a rear end, a left side, and a right side of a base of said table means, said pair of first and second rollers arranged at said front end and said rear end of said table means being freely reciprocable in left and right directions with respect to said direction of said workpiece;

elastic means for pushing said pair of first and second rollers arranged at said front end and said rear end of said table means to be freely reciprocable inwardly in said left and right directions with respect to said width direction of said workpiece are attached to said pair of first and second rollers arranged at said front end and said rear end of said table means to be freely reciprocable rollers; and rollers, arranged at said front end, said rear end, said left, and said right of said table means for feeding said workpiece, push said pair of first and second rollers arranged at said front end and said rear end of said table means to be freely reciprocable rollers against an elasticity of said elastic means because of sliding of said table means for feeding said workpiece in a back and forth direction and fit between said first and second rollers of said groups of rollers in order to control sliding of said table means for feeding said workpiece in said back and forth direction.

5. The cloth fusing press as set forth in claim 3, wherein the table base is provided with guide rails in the back and forth direction and the table for feeding work is provided with rollers traveling in said guide rails.

6. The cloth fusing press as set forth in either claim 1 or claim 2, wherein said base of said table means is provided with guide rails in said direction toward and said direction away from said conveyance means and said table means for feeding said workpiece is provided with rollers traveling on said guide rails.

* * * * *